United States Patent [19]

Probst et al.

[11] Patent Number: 4,999,233

[45] Date of Patent: Mar. 12, 1991

[54] PROTECTIVE GUARD MEMBER

[76] Inventors: Bernard Probst, 103 Crockett St., Cleveland, Tex. 77327; George Spector, 233 Broadway, New York, N.Y. 10007

[21] Appl. No.: 482,011

[22] Filed: Feb. 20, 1990

[51] Int. Cl.[5] ..... E04F 13/06

[52] U.S. Cl. ..... 428/122; 49/462; 52/288; 248/345.1; 428/192

[58] Field of Search ..... 248/345.1; 52/288; 49/462; 428/122, 192

[56] References Cited

U.S. PATENT DOCUMENTS

| | | | |
|---|---|---|---|
| 2,837,787 | 6/1958 | Wright | 49/462 X |
| 3,150,854 | 9/1964 | Jamieson | 248/345.1 |
| 3,318,061 | 5/1967 | Stentz | 49/462 X |
| 4,012,878 | 3/1977 | Ellingson | 248/345.1 X |
| 4,153,230 | 5/1979 | Giacin | 428/11 X |
| 4,240,225 | 12/1980 | Sartain | 248/345.1 X |
| 4,443,508 | 4/1984 | Mehl | 428/192 X |
| 4,582,739 | 4/1986 | Givens | 428/122 X |
| 4,817,902 | 4/1989 | Mason | 248/345.1 |
| 4,877,673 | 10/1989 | Eckelet al. | 248/345.1 X |

*Primary Examiner*—Henry F. Epstein

[57] ABSTRACT

A protective guard member is provided and consists of an elongated body structure formed of a resilient deformable material sized to cover and cushion a sharp corner on a wall, piece of furniture and the like. The elongated body structure is secured in place about the sharp corner so that if a child falls towards the sharp corner the body structure will prevent injury to the child.

2 Claims, 1 Drawing Sheet

PROTECTIVE GUARD MEMBER

BACKGROUND OF THE INVENTION

The instant invention relates generally to protectors and more specifically it relates to a protective guard member which provides a cushion to sharp corners on walls, furniture and the like.

There are available various conventional protectors which do not provide the novel improvements of the invention herein disclosed.

SUMMARY OF THE INVENTION

A primary object of the present invention is to provide a protective guard member that will overcome the shortcomings of the prior art devices.

Another object is to provide a protective guard member that will cushion sharp corners on walls, furniture and the like so that if a child falls against the corners the protective guard member will prevent injury to the child.

An additional object is to provide a protective guard member that can be applied about the sharp corners by suction or light adhesive which will not cause any damage to the walls, furniture and the like when removed therefrom.

A further object is to provide a protective guard member that is simple and easy to use.

A still further object is to provide a protective guard member that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
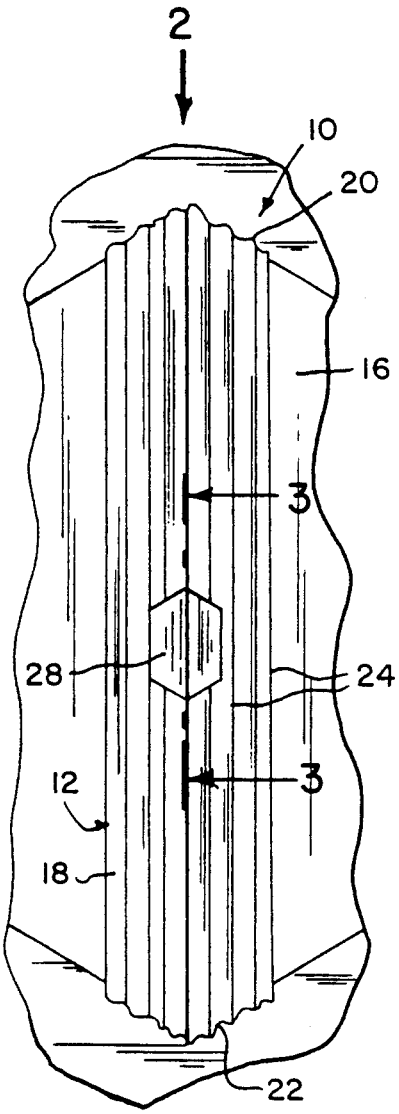
FIG. 1 is a perspective view a wall corner with invention installed thereon by suction.
Figure 2:
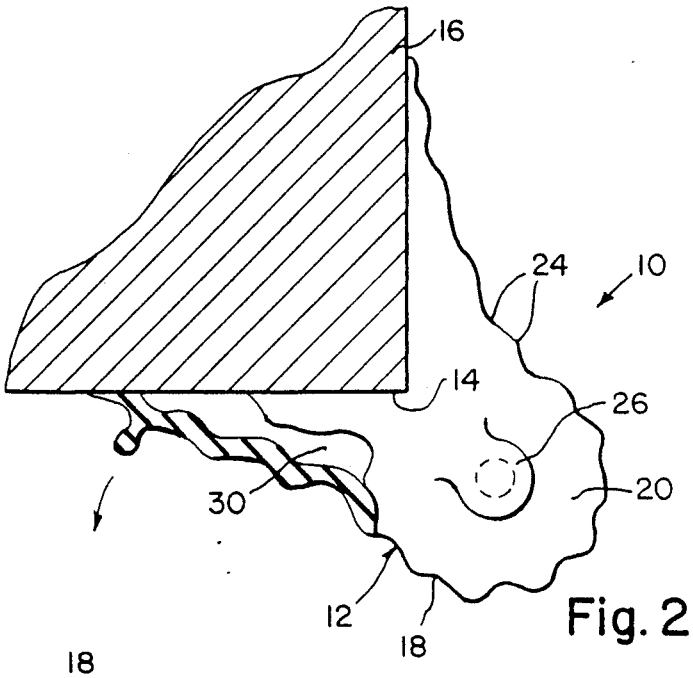
FIG. 2 is an enlarged top view with parts broken away taken in direction of arrow 2 in FIG. 1, showing the valve flap.
Figure 3:
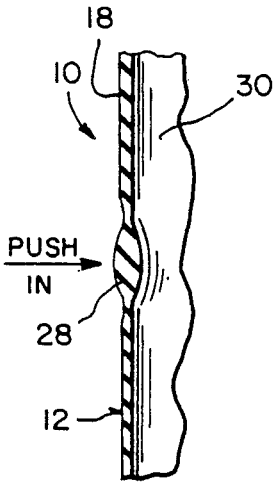
FIG. 3 is a vertical cross sectional view taken along line 3—3 in FIG. 2, showing the push portion in greater detail.

Turning now descriptively to the drawings, in which similar reference characters denote similar elements throughout the several views, FIGS. 1 through 3 illustrate a protective guard member 10 consisting of an elongated body structure 12 formed of a resilient deformable material sized to cover and cushion a sharp corner 14 on a wall 16, piece of furniture and the like. The elongated body structure 12 is secured in place about the sharp corner 14 so that if a child falls towards the sharp corner 14, the body structure will prevent injury to the child.

The elongated body structure 12 is a rubber bumper 18, U-shaped in cross section and having a top wall 20, a bottom wall 22 and plurality of vertical ribs 24 therealong on the bumper 18. A valve flap 26 is formed on the top wall 20 of the rubber bumper 18. An air pump button 28 is formed on the rubber bumper 18 midway between the top wall 20 and the bottom wall 22. When the rubber bumper 18 is placed against the wall 16 at the sharp corner 14 the air pump button 28 can be pushed in to release some of the air through the valve flap 26 creating an air suction 30 therebetween to secure the rubber bumper 18 and prevent damage to the surface of the wall 16 and the sharp corner 14.

Figure 4:
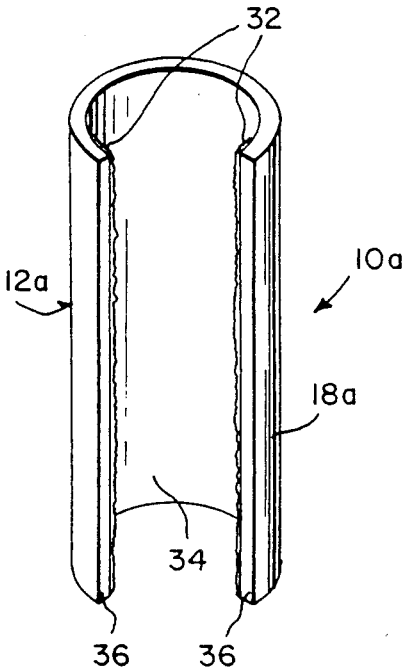
FIG. 4 is a perspective view of a modification of the invention being C-shaped in construction.
Figure 5:
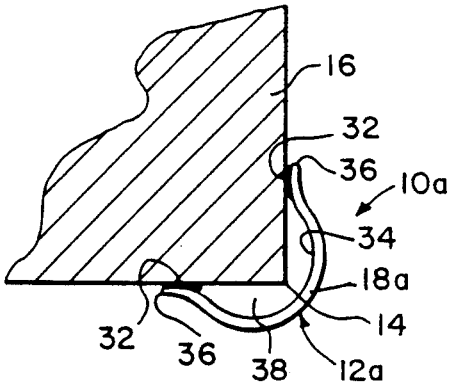
FIG. 5 is a top view of the modification applied to the corner of the wall by adhesive.

A modified protective guard member **10*a* is shown in FIGS. 4 and 5 whereby the elongated body structure 12*a* is a rubber bumper 18*a* C-shaped in cross section. A strip of adhesive material 32 is applied to inner surface 34 of the rubber bumper 18*a* t each edge 36 thereof. When the edges 36 are bent outward and the strips of adhesive material 32 are applied on either side of the sharp corner 14 an air space 38 is created between the wall 16 and the rubber bumper 18*a***.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A protective bumper comprising:

(a) an elongated resilient body adapted to engage, cover and cushion a sharp structural corner on a wall and (b) suction means incorporated in said body for securing said body in place along said sharp corner to prevent injury to a child falling against said sharp corner, (c) said body having side walls enclosing a space between said corner and body; wherein said body is U-shaped in cross section having a top wall and a plurality of longitudinal vertical ribs on said bumper to provide greater flexibility for vacuum producing purposes; wherein said suction means includes (d) a one way valve flap formed on said top wall, permitting air flow from said space and (e) an air pump reciprocable button formed on said bumper so that when said bumper is placed against said corner, said air pump button can be pushed in to force air out through said valve flap creating suction to secure the bumper on said corner.

2. A bumper as in claim 1 wherein said button is located centrally between said walls comprising a thickened portion secured to said body by thinner elastic portions and wherein said side walls have edge surfaces conforming to the corner surfaces.

* * * * *